US008403285B2

(12) United States Patent
Bett et al.

(10) Patent No.: US 8,403,285 B2
(45) Date of Patent: Mar. 26, 2013

(54) TRANSPORT DEVICE

(75) Inventors: Thorsten Bett, Hoevelhof (DE); Thorsten Bornefeld, Schlangen (DE); Michael Gockel, Bad Driburg (DE); Andreas Wieneke, Lemgo (DE); Thorsten Rieke, Detmold (DE); Ditmar Schreiber, Bad Lippspringe (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 13/079,004

(22) Filed: Apr. 3, 2011

(65) Prior Publication Data

US 2011/0253871 A1 Oct. 20, 2011

(30) Foreign Application Priority Data

Apr. 16, 2010 (DE) ..... 20 2010 005 767 U

(51) Int. Cl.
*A47B 91/00* (2006.01)

(52) U.S. Cl. ..... 248/346.03; 248/686; 361/737

(58) Field of Classification Search ..... 248/346.03, 248/346.01, 346.02, 346.05, 686, 692, 444.1; 361/737, 715, 752, 790, 801, 802
See application file for complete search history.

(56) References Cited

U.S. PATENT DOCUMENTS

| | | | | |
|---|---|---|---|---|
| 5,042,184 | A * | 8/1991 | Fast | 40/663 |
| 5,315,774 | A * | 5/1994 | Chompff | 40/316 |
| 5,497,297 | A * | 3/1996 | Kilmer et al. | 361/737 |
| 6,166,913 | A * | 12/2000 | Fun et al. | 361/737 |
| 6,483,719 | B1 * | 11/2002 | Bachman | 361/816 |
| 6,632,997 | B2 * | 10/2003 | Hoffman et al. | 174/527 |
| 7,173,826 | B1 * | 2/2007 | Chiou et al. | 361/737 |
| 7,194,829 | B2 * | 3/2007 | Boire et al. | 40/316 |
| 7,249,978 | B1 * | 7/2007 | Ni | 439/660 |
| 7,367,149 | B2 * | 5/2008 | Fast et al. | 40/649 |
| 7,440,285 | B2 * | 10/2008 | Centofante | 361/737 |
| 7,649,741 | B2 * | 1/2010 | Liu | 361/737 |
| 7,804,163 | B2 * | 9/2010 | Hiew et al. | 257/679 |
| 7,856,745 | B2 * | 12/2010 | Schweikert et al. | 40/316 |
| 8,072,738 | B2 * | 12/2011 | Kendall et al. | 361/679.01 |
| 8,259,453 | B2 * | 9/2012 | Morita et al. | 361/737 |
| 2007/0279874 | A1 * | 12/2007 | Gu et al. | 361/737 |

FOREIGN PATENT DOCUMENTS

| | | | |
|---|---|---|---|
| DE | 3443170 | A1 | 5/1986 |
| DE | 3725217 | A1 | 2/1989 |
| DE | 102005058387 | A1 | 6/2007 |
| DE | 102007011179 | A1 | 9/2008 |

* cited by examiner

*Primary Examiner* — Terrell McKinnon
*Assistant Examiner* — Monica Millner
(74) *Attorney, Agent, or Firm* — Lawrence E. Laubscher, Sr.; Lawrence E. Laubscher, Jr.

(57) ABSTRACT

A label transport device for transporting indicia-bearing labels for identifying electrical and electronic components, comprising a generally rectangular carrier frame member having a generally planar support surface, a generally rectangular planar indicia-bearing label, and a mounting arrangement for mounting the label on the carrier frame, including at least one positioning tab member connected with one edge of the label, and a positioning lug arranged on one of the frame and tab members for engagement with an opening contained in the other of the tab and frame members, thereby to position the label at a given transport location on the carrier frame member. The frame is injection-molded from a synthetic plastic material and includes a plurality of parallel spaced longitudinal spars that are connected together integrally by a plurality of parallel transverse spars.

14 Claims, 7 Drawing Sheets

Fig. 14
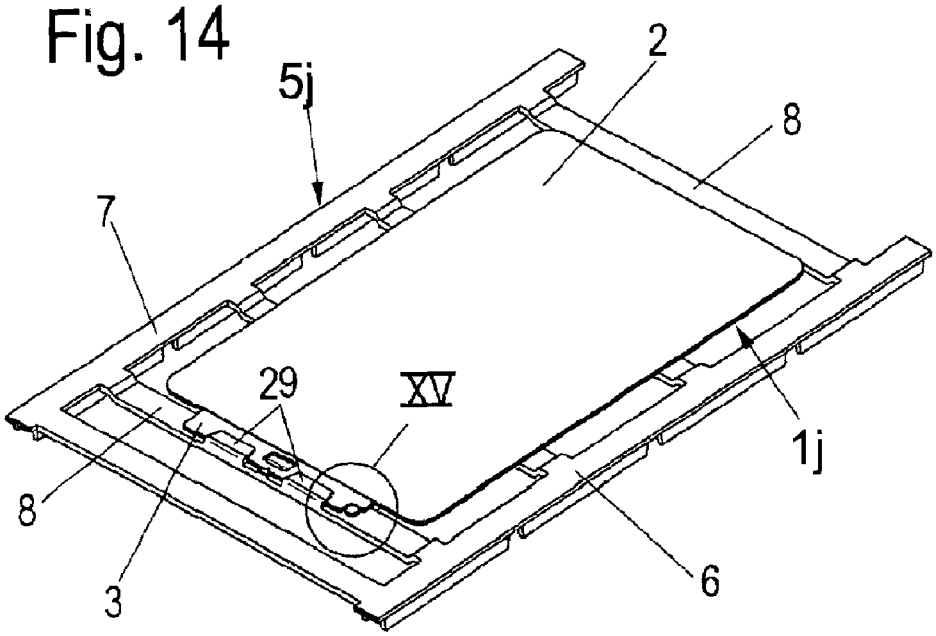
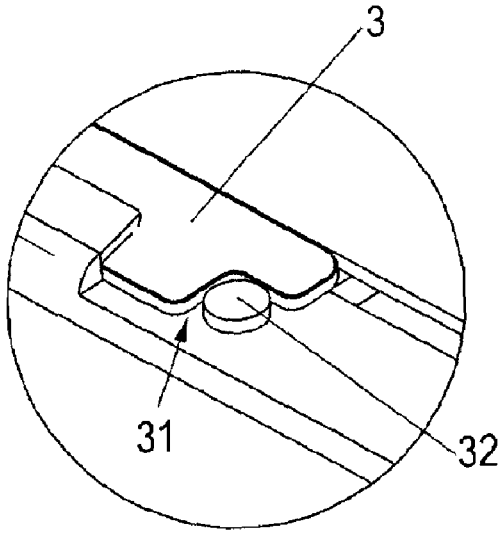
Fig. 15

TRANSPORT DEVICE

BACKGROUND OF THE INVENTION

1. Field of the Invention

A label transport device for transporting indicia-bearing labels for identifying electrical and electronic components, comprising a generally rectangular carrier frame member having a generally planar support surface, a generally rectangular planar indicia-bearing label, and a mounting arrangement for mounting the label on the carrier frame, including at least one positioning tab member connected with one edge of the label, and a positioning lug arranged on one of the frame and tab members for engagement with an opening contained in the other of the tab and frame members, thereby to position the label at a given transport location on the carrier frame member.

2. Description of Related Art

It is known to provide labeling tags, cards, panels and strips for identifying electric conductors, cables and the like, as well as to identify building modules mounted in switch boards. These labeling devices are necessary because the relevant components, building modules or devices are installed in a relatively large number of units into a switch board, for example. Each component, building module or device is assigned a specific function so that it must be discernible, which component, building module or device has to be replaced, in case of any malfunction. Based on the relative high amount of required labeling cards and to obtain a good printing picture, the labeling cards are printed on by means of a suitable printer in continuous process. Qualified printers are generally designed as ink jet printers. After applying the printed image, it is thermally fused. This produces labeling cards of particularly high quality, which are smear and scratch resistant and can be used immediately after curing of the printed image.

Those labeling cards that are made of a synthetic plastic are generally manufactured by an injection molding process. Internal friction, which can be triggered by the injection molding procedure, can cause distortion of said labeling cards, i.e. they differ from flatness. Provided this has not already taken place during injection molding, the labeling cards distort due to thermal fusing of the printed images because the internal friction is disengaged by means of thermal stress.

The present invention was developed to provide separately manufactured labeling cards that are assembled to one transport unit for printing and that said transport unit can be guided through a printer by means of a continuous process.

SUMMARY OF THE INVENTION

A primary object of the invention is to provide a label transport device for transporting indicia-bearing labels for identifying electrical and electronic components, comprising a generally rectangular carrier frame member having a generally planar support surface, a generally rectangular planar indicia-bearing label, and a mounting arrangement for mounting the label on the carrier frame, including at least one positioning tab member connected with one edge of the label, and a positioning lug arranged on one of the frame and tab members for engagement with an opening contained in the other of the tab and frame members, thereby to position the label at a given transport location on the carrier frame member.

According to a more specific object, the frame is injection-molded from a synthetic plastic material and includes a plurality of parallel spaced longitudinal spars that are connected together integrally by a plurality of parallel transverse spars. Locking projections may extend from the label tabs into corresponding locking recesses contained in the transverse carrier frame spars. Code means may be provided for assuring that the proper label card is mounted on the proper carrier frame.

According to another object, the carrier frameworks and labeling cards are now created in separate procedures. The labeling cards are inserted into the carrier framework and fixed by clamping or catching, whereas the centering elements secure that the labeling cards lie in a constantly steady position within the frame areas. The transport unit is formed by the carrier framework and the labeling cards, which are inserted into the frame areas.

The catch, clamping and centering elements are arranged in a way that temperature induced or moisture induced minor changes in the dimensions can be compensated for.

A preferred embodiment provides that the frame areas of the carrier framework are restricted by two parallel and spaced apart longitudinal spars, and by transverse spars, which connect the longitudinal spars for the formation of the individual frame areas. For the purpose of centering the labeling cards in the frame areas, the embodiment provides that the catch and centering webs of the labeling cards are provided with a centering recess, respectively, which lockingly encompasses the respective increments of the transverse spars of the carrier framework. The reversion of this procedure is possible, as well.

The printable area of the labeling cards must be separated from the catch and centering webs after printing. In order for said separation to be implemented without any tools, the embodiment provides that the catch and centering webs are connected via predetermined frangible breaking points, for example by means of grooves or indentations and the like, to the printable field.

A preferred embodiment furthermore provides that two catch and centering webs of the labeling cards are provided at two opposing sides, which are associated with the transverse spars of the carrier framework. The edges of the labeling cards facing the longitudinal spars are then in contact with the longitudinal spars without a spacing relative to each other or essentially without a spacing relative to each other. It cannot be prevented that the dimensions of the labeling cards show minor changes due to temperature or moisture fluctuations. Therefore, the embodiment provides that the catch, centering and clamping elements follow a minor respective displacement of the labeling cards in the direction of the longitudinal spars and/or transverse spars. Regardless of the fact whether the labeling cards are made of metal or plastic, a preferred provision is that the carrier frameworks are formed from one-piece pre-forms made of a non-metal material, preferably plastic pre-forms manufactured by an injection molding process. Said process uses a material, which prevents a distortion of the carrier frameworks during fixation of the printing images by means of relatively high temperatures. It is known in the art that metal parts can distort due to exposure to heat.

The embodiments of the catch, centering and clamping elements are at least partially dependant on the fact whether the labeling cards are manufactured from metal or plastic.

The following embodiments are preferably suitable for labeling cards, which are manufactured from plastic.

The clamping and centering elements in one possible embodiment comprise at least one elongated hole into which engage a catch web or snap-in tongues arranged in pairs. Preferably, however, at least one elongated hole is provided in a transverse spar, which restricts a frame area, into which hole a catch web engages, which is molded to a catch and centering web, whereas the length of each longitudinal hole is a little bit larger than the length of the catch web. Preferably, however, two longitudinal holes spaced apart are provided in said transverse spar, the end ranges of which are shaped circularly. These longitudinal holes run crosswise to the longitudinal spars of the carrier framework, so that a certain displacement of the labeling cards in the direction of the longitudinal spars is possible. The catch webs molded to the catch and centering web are shaped like a harpoon.

At the second transverse spar, which restricts a frame area, at least one longitudinal hole is provided, as well, the length of which also is a little bit larger than the length of the engaging catch web. This longitudinal hole or these longitudinal holes and thus the catch webs, run parallel and spaced apart to the longitudinal spars of the carrier framework, however, so that a displacement exists in longitudinal direction. In both cases, however, the position of the labeling card is determined by the centering recess and by the corresponding increment.

Alternatively, it is also possible, however, that one or several snap-in tongues, which are elastic, are molded to the catch and centering web, instead of a catch web. The following embodiment is suitable particularly for labeling cards made of metal. A first embodiment provides at least one stop-collar with an angular cross section, which is molded to one transverse spar of the carrier framework, preferably, however, to two transverse spars of the carrier framework, the stop-collar leg of which is positioned vertically with respect to the level of the carrier framework and forms a stop-collar, and the embodiment provides that the web parallel with respect to the level of the carrier framework overlaps the catch and centering web of the labeling card.

In this embodiment, the centering can be implemented by means of a centering recess of the catch and centering web and a corresponding increment in the transverse spar, as well. Preferably, however, two angular stop-collars are molded to each transverse spar. Alternatively, it is also possible, however, that an angular stop-collar is molded to a transverse spar in the middle section and that yet further stop-collars in the form of an increment are molded to both sides of this angular stop-collar. Because metallic material can be cold-formed, it is alternatively provided that the catch and centering web of the labeling card has angular position webs, which can be inserted into the corresponding recesses of the associated transverse spar. If two position webs are provided, a sideways displacement is not possible, any longer. In order for the labeling cards to be positioned with the printed area averted to the transverse spars of the carrier framework, it is furthermore provided that an angular area is provided at the catch and centering web, which area is formed by a pull-in or a cut-out. A pin of the transverse spar is in contact with these areas. Due to said asymmetrical formation, it is not possible that the labeling cards are facing the transverse spars of the carrier framework with their printable surfaces. Correspondingly, said embodiment could also be described as encoding. Especially if the labeling cards are manufactured from metal, it is possible that several strip-type labeling cards can be aggregated to one printable card, with the individual strip-type cards being connected to each other via predetermined breaking points so that they can be separated from another without any tools.

In order for the printable area of every labeling card to be on top, i.e. averted to the carrier framework, it is provided that a recess or a hole is provided at least one catch and centering web, into which a pin engages, and that the recess or the hole is off-set with respect to the middle longitudinal axis of the labeling card. As a result, the position of the labeling card is pre-determined. Correspondingly, said configuration could also be determined as encoding.

Preferably, the size of a labeling card corresponds to the generally known size of a check card; nevertheless, other dimensions can be chosen, as well.

BRIEF DESCRIPTION OF THE DRAWINGS

Other objects and advantages of the invention will become apparent from a study of the following specification, when viewed in the light of the accompanying drawing, in which:

FIG. 14 is a perspective view of a coding embodiment of the invention; and

FIG. 15 is a detailed view of the coding means of FIG. 14.

DETAILED DESCRIPTION OF THE INVENTION

Figures 1, 2:
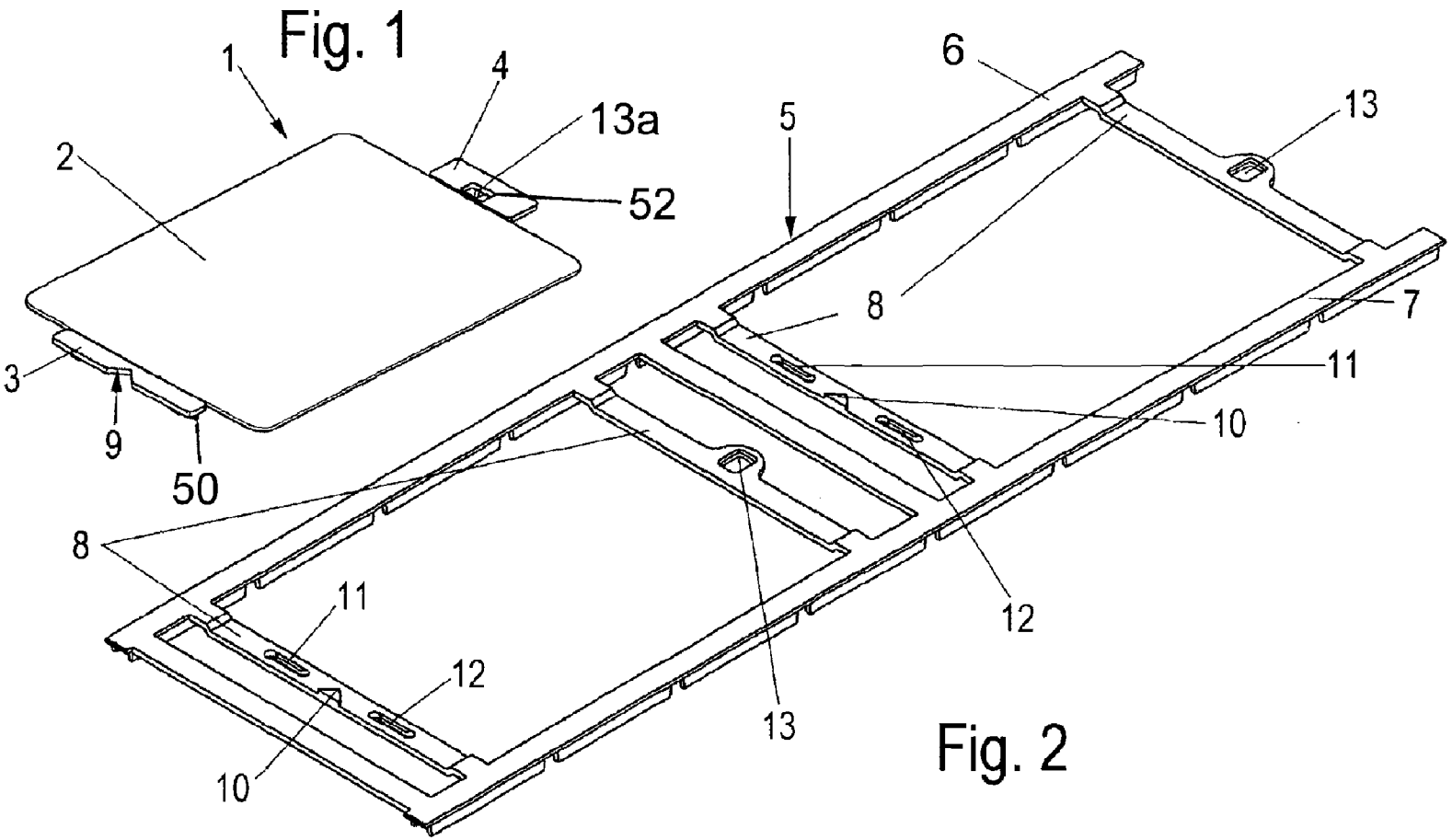
FIG. 1 is a perspective view of the labeling card of the present invention and FIG. 2 is a perspective view of the carrier frame upon which the labeling card is mounted.

FIG. 1 shows a preferred embodiment of a labeling card 1, which is manufactured from a plastic by way of an injection molding process. Labeling card 1 comprises a printable field 2 of the size of a check card and a catch and a respective centering web 3 and 4 at two opposing sides. Several or a plurality of these labeling cards 1 are inserted into a carrier framework 5, to be further illustrated in detail, for the purpose of printing. Said carrier framework 5 comprises two parallel longitudinal spars 6, 7 spaced apart from another, and several rectangular transverse spars 8, with two transverse spars 8 restricting one frame area, respectively. As shown particularly in FIG. 3, the catch and centering webs 3 and 4 support themselves against the transverse spars 8, which restrict the frame area.

FIG. 1 shows distinctly, that the catch and centering web 3 is provided with a triangular center recess 9 in the central section, which engages into a corresponding lug projection 10 of the transverse spar 8, if labeling card 1 is superposed. Furthermore, FIG. 2 shows that on both sides of said triangular lug projection 10 longitudinal holes 11, 12 are provided. Said longitudinal holes 11, 12 proceed circularly in the end ranges. The opposite catch and centering web 4 can be provided with a yet another longitudinal hole or a similar recess 13*a* having a partially punched out downwardly extending web or flap 52. The catch and centering webs 3, 4, at the sides facing the transverse spars 8, are provided with harpoon-shaped catch webs 50, which engage with said longitudinal holes 11, 12 and said recess 13. As a result, the catch mechanism of labeling card 1 is secured.

Figure 3:
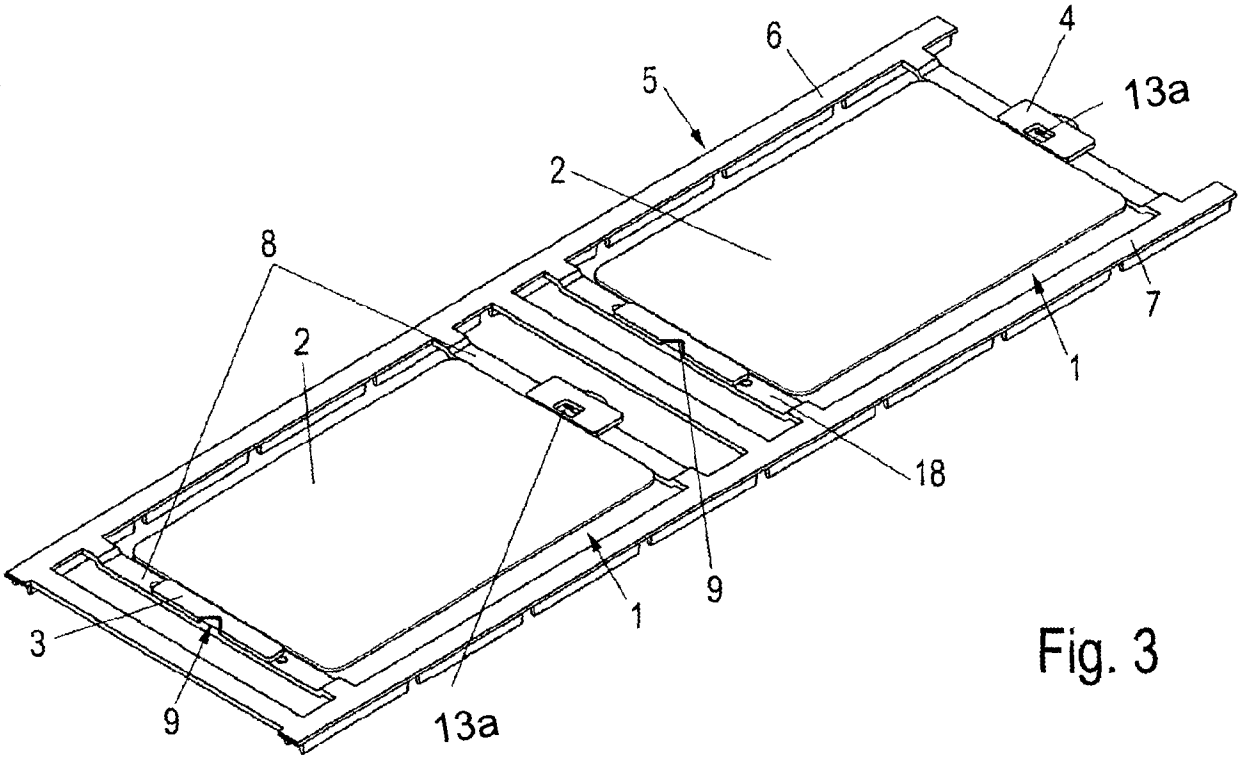
FIG. 3 is a perspective view illustrating the labeling card of FIG. 1 mounted on the carrier frame of FIG.2.

As illustrated in FIGS. 1 to 3, catch and centering webs 3, 4 are molded to the edges 5, which are positioned crosswise to the longitudinal spars 6, 7 of the carrier framework. Two harpoon-shaped catch flaps 50 are molded to catch and centering web 3, while only one catch flap 52 is molded to the opposite catch and centering web 4. The catch webs molded to catch and centering web 3 are also positioned crosswise to transverse spars 6, 7 of carrier framework 5. The catch flap 52 molded to catch and centering web 4 runs parallel to longitudinal webs 6, 7. The lengths of these catch flaps are smaller than the lengths of longitudinal holes 11, 12 and recess 13 so that slight changes based on thermal influence or the influence of moisture related changes can be compensated for. As shown in FIG. 2, the apices of the triangles defined by the centering recess 9 and the positioning lug 10 are directed longitudinally toward the opening 13*a* in web 4 and toward the opening 13 contained in the associated spar, respectively.

Figure 4:
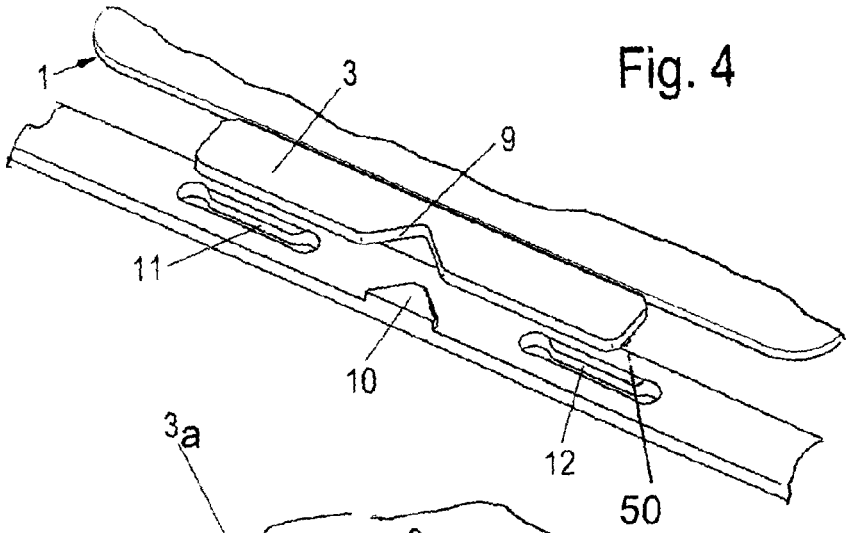
FIG. 4 is a detailed perspective view of the centering and connecting means of the apparatus of FIG. 3.

FIG. 4 shows catch and centering web 3 and the associated section of transverse spar 8 in an enlarged, perspective illustration.

Figure 5:
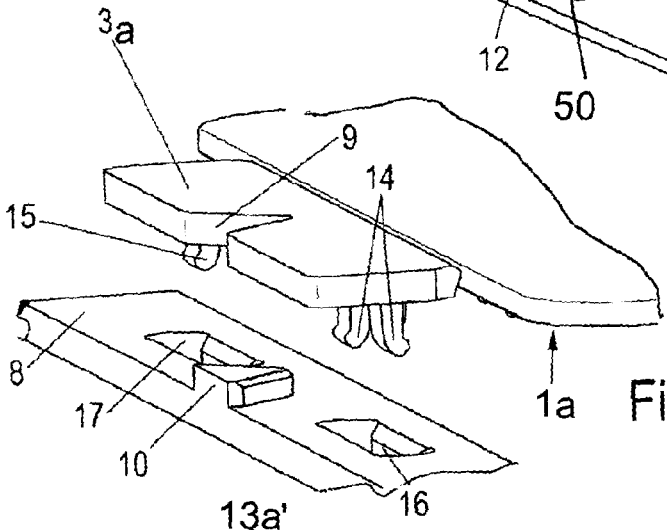
FIGS. 5 and 6 are detailed perspective view of another embodiment of the invention.
Figure 6:
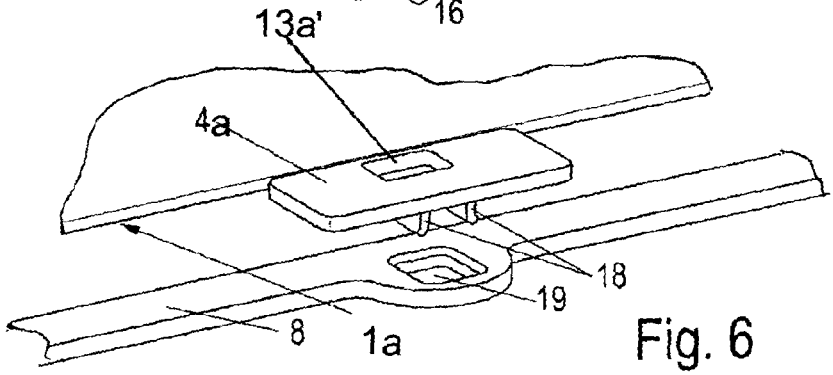

FIGS. 5 and 6 show the two transverse spars 8, which restrict a frame area of carrier framework 5. For this embodiment, two pairs of snap-in tongues 14, 15 are molded to the bottom of catch and centering web 3*a*, which are elastic and engage with corresponding recesses 16, 17 of the associated transverse spar 8. As shown in the figure, these snap-in tongues 14, 15 are elastic crosswise to the corresponding transverse spar 8.

FIG. 6 shows that a pair of spring tongues 18 is molded to the opposite catch and centering web 4. These snap-in tongues 18 engage with a recess 19 of transverse spar 8. FIG. 6 shows that snap-in tongues 18 can expand in the longitudinal direction of transverse spar 8.

Figure 7:
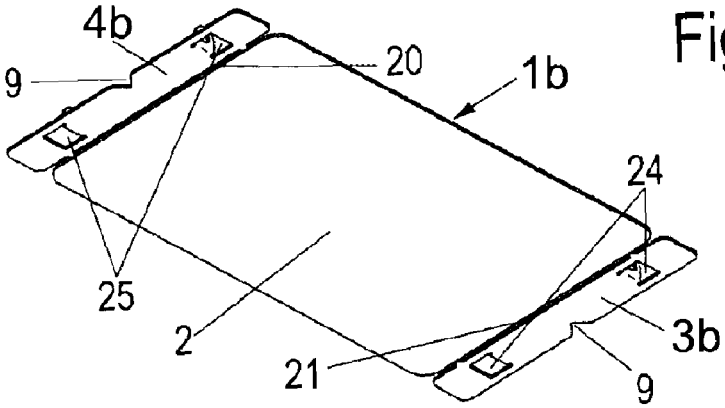
FIG. 7 is a perspective view of another embodiment of the labeling card.
Figure 8:
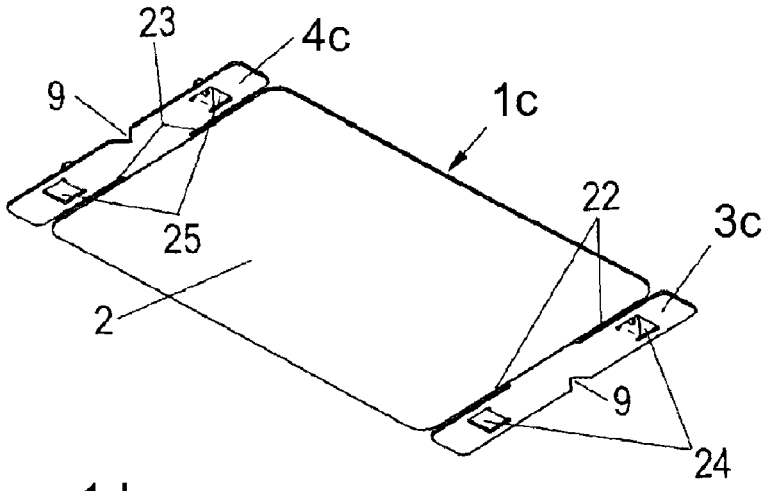
FIG. 8 illustrates a modification of the embodiment of FIG.7.

FIGS. 7 and 8 illustrate two labeling cards 1*b* and 1*c* that are made of metal. This labeling card are provided with a respective catch and centering web 3 and 4 at both edges running normal to longitudinal spars 6, 7. After printing, said catch and centering webs 3 and 4 can be broken off the printed field 2 of labeling card 1 without any tools. According to the embodiment in FIG. 7, the connections of labeling card 1*b* are weakened by horizontal reduction of the catch and centering webs 3*b* and 4*b*, for said purpose. These areas can be formed by means of one- or double-sided grooves 20, 21 for the embodiment according to FIG. 7, with said grooves being continuous.

The embodiment of FIG. 8 provides indentations 22, 23 extending from the longitudinal edges, which are not continuous, so that the predetermined braking points are predetermined by said indentations 22, 23. Because said catch and centering webs 3*c* and 4*c* are made of cold-formed metal, cut-outs 24, 25 are provided within the two catch and centering webs 3*c* and 4*c*, with these material parts positioned within the cut-outs being formed by angled positioning flaps 26 in the respective direction of transverse spar 8. Said recesses are designed from a point of view of size in a way that the elongation of labeling card 1*c* in longitudinal and crosswise direction can be compensated for. Centering is still implemented by centering recesses 9 and lug projections 10, which are in effective connection therewith.

Figure 9:
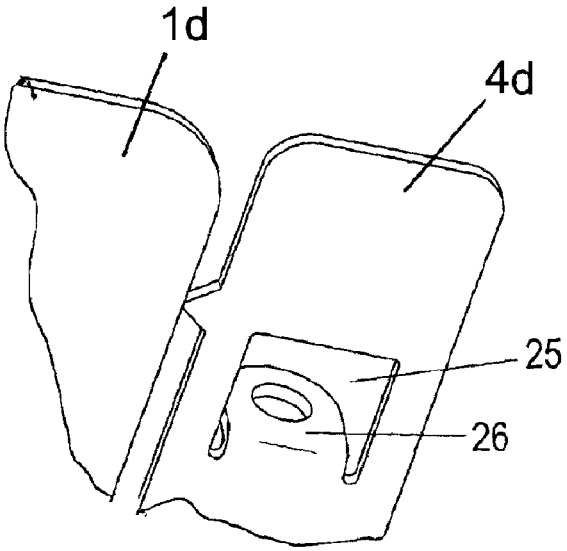
FIG. 9 is a detailed perspective view of the locking means of FIG. 8.

FIG. 9 shows an enlargement of the connection, which can also be described as a micro connection, between the labeling card 1*d* and catch and centering webs 3*d*, 4*d*. The connections are implemented by triangles so that a relatively small area exists between the catch and centering webs 3*d*, 4*d* and labeling card 1*d*, so that these connections can be disengaged particularly easily.

Figure 10:
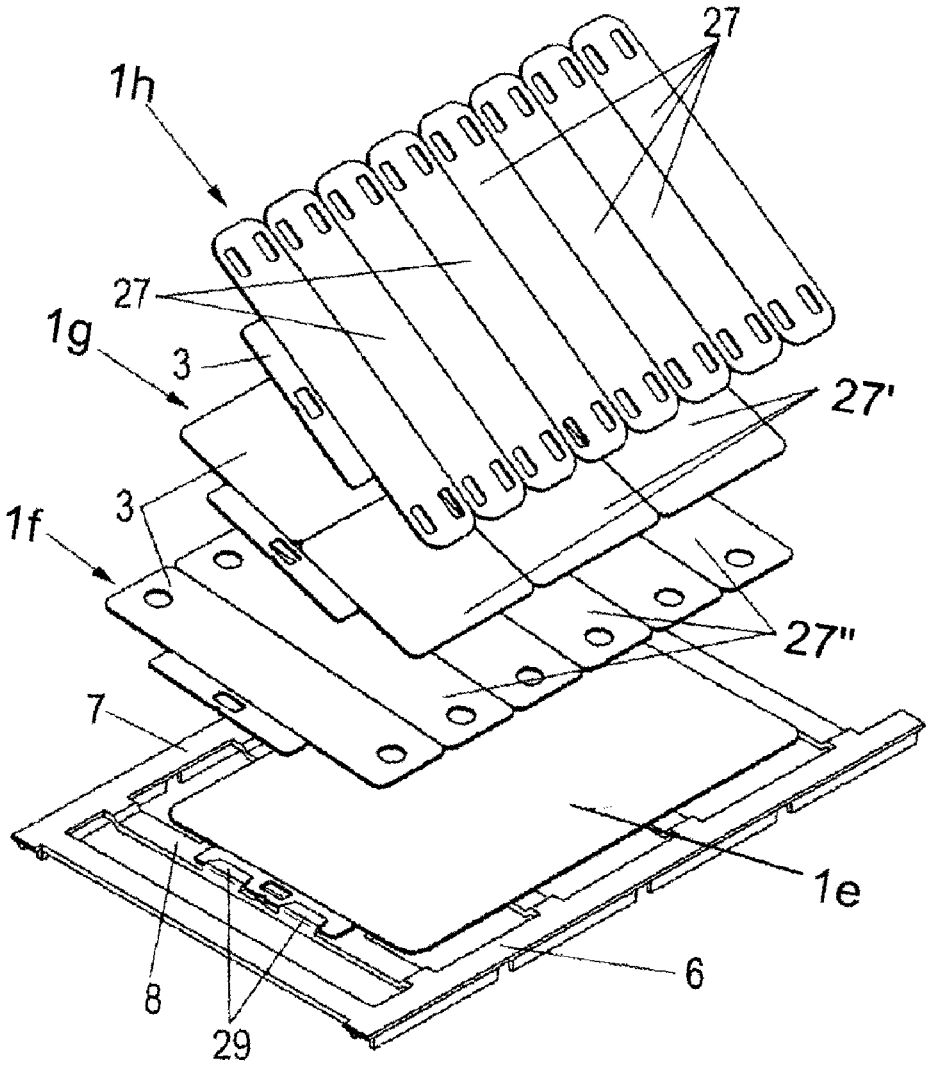
FIG. 10 is a perspective view of a further embodiment of the invention.

FIGS. 10-13 show further variations. FIG. 10 shows that a labeling card 1*e* of the size already shown in the previous figures, can comprise individual labeling strips 27, which exhibit different widths. Several labeling strips 27 can then be printed, simultaneously. Furthermore, FIG. 10 shows that labeling strips 27 can be provided with drilled holes or longitudinal holes at one or both ends. Clamping and centering is being implemented in the manner already described above.

Figure 11:
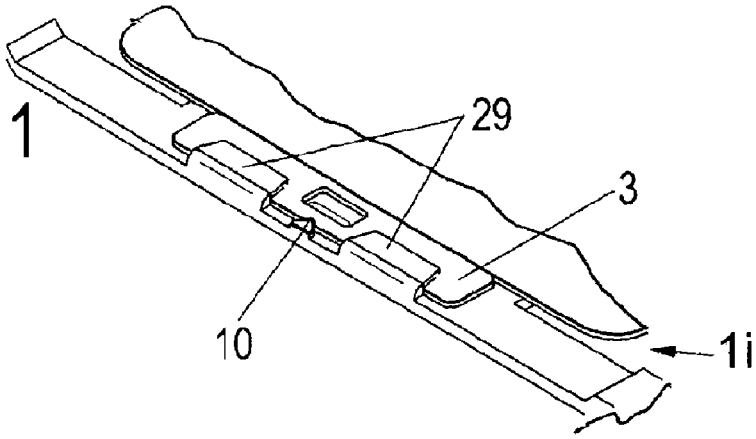
FIG. 11 illustrates in detail a modification of the apparatus of FIG. 10.
Figure 12:
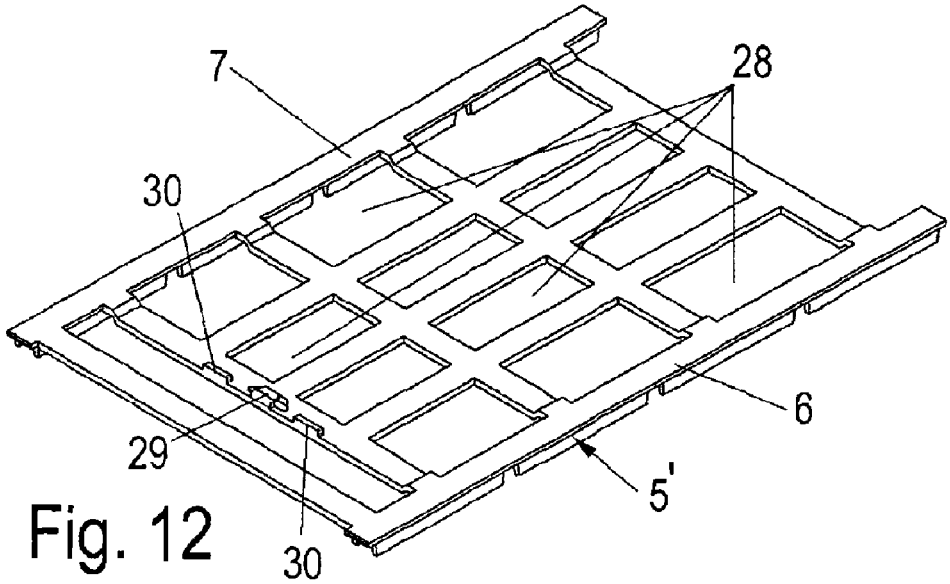
FIG. 12 is a perspective view of another embodiment of the carrier frame.
Figure 13:
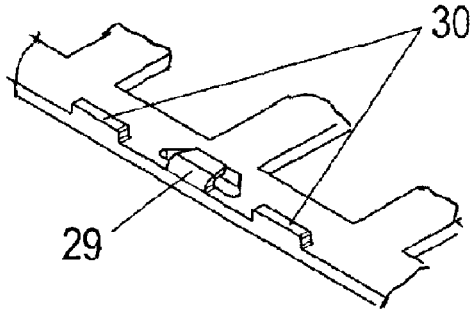
FIG. 13 is a detailed perspective view of the positioning means of FIG. 2.

FIGS. 11-13 show several possibilities of fixating the labeling cards 1. This can be implemented by angular webs 29, pursuant to FIG. 11, with the vertical webs forming stop collars, and the webs parallel to and spaced apart from transverse spar 8 forming clamping webs. Pursuant to FIG. 12, fixation of the labeling card 1*i* can also be implemented by one angular web 29 and two sideways stop collars 30. FIG. 13 shows said fixation in an enlarged illustration.

Furthermore, FIG. 12 shows that carrier framework 5' is provided with a contact surface, which is grid-like, so that carrier framework 5' is provided with recesses 28 in a material-efficient way.

FIGS. 14 and 15 show a so-called encoding arrangement which causes the labeling card 1*j* to always lay on top with the printable area 2, i.e. averse to carrier framework 5. For this purpose, at least one catch and centering web 3 is provided with a recess 31, which is offset to the middle center axis of the labeling card 1. A pin 32, which is molded to the transverse spar 8, engages with this cut-out or recess 31.

The invention is not limited to the depicted exemplary embodiments. It is essential that the labeling cards 1, consisting of metal or plastic, are provided with one catch and centering web 3, 4, respectively, on two opposing sides, which web is connected with the printable field 2 via predetermined breaking points 20, 21, 22, 23, so that a separation can be implemented without any tools. Furthermore, it is essential that the catch and centering webs 3, 4 are provided with centering recesses 9, into which increments 10 engage. Furthermore, it is important, that the catch webs or snap-in tongues 14, 15 are arranged in the catch recesses in a way that changes of labeling card 1 due to thermal influences or moisture influences can be compensated for.

While in accordance with the provisions of the Patent Statutes the preferred forms and embodiments of the invention have been illustrated and described, it will be apparent to those skilled in the art that changes may be made without deviating from the invention described above.

What is claimed is:

1. A label transport device for transporting indicia-bearing labels for identifying electrical and electronic components, comprising:

(a) a generally rectangular injection-molded synthetic plastic carrier frame member (5;5') having a generally planar horizontal support surface, said frame including:

(1) a plurality of parallel spaced longitudinal spars (6,7); and (2) a plurality of parallel spaced transverse spars (8) arranged normal to and connected between said longitudinal spars;

(b) a generally rectangular planar indicia-bearing label (1) formed of synthetic plastic material, said label having a pair of longitudinal side edges parallel with said frame longitudinal spars, and a pair of opposed transverse end edges; and (c) mounting means for mounting said label on said frame support surface, including:

(1) a pair of catch and centering webs connected with said label transverse end edges, respectively, a first one (3) of said catch and centering webs containing:
  (a) a positioning recess (9) that is centrally located relative to said label longitudinal side edges, and
  (b) a pair of integral downwardly-extending first catch flaps (50) arranged on opposite sides of said central recess;
  (c) the other (4) of said catch and centering webs containing a generally centrally-arranged downwardly extending second catch flap (52); and
(2) a positioning lug (10) arranged centrally on, and extending upwardly from, a first one of said transverse spars, said first transverse spar containing on each side of said positioning lug a linear catch opening (11, 12) extending longitudinally of said first spar;
(3) a second one of said transverse spars containing a central catch opening (13) adapted to receive said second catch flap;
(4) said transverse spars being so arranged that when said label is initially place above said frame with said positioning lug inserted into said positioning recess, said catch flaps are arranged over the corresponding catch openings, respectively, whereby upon downward displacement of said label relative to said frame, said catch flaps extend into engagement with said catch openings, respectively.

2. A label transport device as defined in claim 1, wherein each of said catch and centering webs is connected with said label by a frangible line of breakage (20, 21, 22, 23), thereby to permit the manual separation of said tab from said label.

3. A label transport device as defined in claim 1, and further including at least one locking projection (50; 14,15) extending from said label tab into a corresponding locking opening (11, 12; 16, 17) contained in said one transverse spar adjacent said positioning lug.

4. A label transport device as defined in claim 3, wherein said one locking projection includes a pair of resilient tongues (14, 15) that are biased apart toward locking engagement with the corresponding locking opening.

5. A label transport device as defined in claim 4, wherein the other of said label tabs (4*a*) includes a locking projection (18) that extends into a corresponding locking opening (19) contained in another one of said transverse spars.

6. A label transport device as defined in claim 3, wherein said locking projection (26) comprises a flap partially punched out from the associated label tab.

7. A label transport device as defined in claim 1, and further including slot and lug code means (31, 32) carried by said transverse spar and said label tab for confirming the mounting of a given label on a corresponding given carrier member.

8. A label transport device as defined in claim 1, wherein said label contains a plurality of parallel transverse frangible lines of breakage, thereby to permit breaking of the label into a plurality of smaller label strips (27).

9. A label transport device as defined in claim 1, wherein said longitudinal and transverse spars define a grid-like configuration containing a plurality of recesses (28).

10. A label transport device as defined in claim 1, and further including stop collar means (29) provided on one of said transverse spars for engagement by the associated label tab, thereby to prevent longitudinal movement of said label relative to said carrier frame.

11. A label transport device as defined in claim 1, wherein said positioning recess and said positioning lug have corresponding triangular cross-section configurations, the apices of the triangles defined by said positioning recess and said positioning lug extending toward the second one of said catch and centering webs and the second one of said transverse spars, respectively.

12. A label transport device as defined in claim 1, wherein said second catch flap is formed by partial punching out an opening in said second catch and centering web.

13. A label transport device as defined in claim 1, wherein the dimensions of said catch openings (11, 12, 13) in the direction transversely of said frame are greater than the corresponding dimensions of the associated catch flaps, respectively, thereby to compensate for the influence of temperature and moisture.

14. A label transport device as defined in claim 1, wherein said frame includes a plurality of said mounting means for mounting a plurality of labels in longitudinally spaced relation on said frame.

* * * * *